United States Patent [19]

Zeppenfeld

[11] 4,424,466

[45] Jan. 3, 1984

[54] CATHODE RAY TUBE WITH MULTIPOLE CORRECTION RING

[75] Inventor: Klaus W. M. P. Zeppenfeld, Heerlen, Netherlands

[73] Assignee: U.S. Philips Corporation, New York, N.Y.

[21] Appl. No.: 189,468

[22] Filed: Sep. 22, 1980

[30] Foreign Application Priority Data

Oct. 2, 1979 [NL] Netherlands ..... 7907305

[51] Int. Cl.[3] ..... H01J 29/74

[52] U.S. Cl. ..... 313/433; 313/437

[58] Field of Search ..... 313/437, 443, 433, 439, 313/432

[56] References Cited

U.S. PATENT DOCUMENTS 2,102,421 12/1937 Kuehni ..... 313/433
2,258,643 10/1941 De Gier et al. .
2,619,607 11/1952 Steers ..... 313/443
3,023,336 2/1962 Frenkel ..... 313/437 X
3,217,200 11/1965 Gethmann ..... 313/443
3,819,984 6/1974 Hawken ..... 315/27 GD
4,220,897 9/1980 Barten et al. ..... 315/368

FOREIGN PATENT DOCUMENTS 529341 11/1940 United Kingdom ..... 313/433

*Primary Examiner*—Palmer C. Demeo
*Attorney, Agent, or Firm*—Robert J. Kraus

[57] ABSTRACT

A cathode ray tube including, in an evacuated envelope, at least one electron gun to generate an electron beam directed onto a target, and first and second pairs of deflection plates for deflecting the electron beam in two mutually perpendicular directions. Various defects in the displayed image are corrected by providing at least one ring of magnetizable material, permanently magnetized as a multipole, between the first pair of deflection plates and the target.

8 Claims, 6 Drawing Figures

CATHODE RAY TUBE WITH MULTIPOLE CORRECTION RING

BACKGROUND OF THE INVENTION

The invention relates to a cathode ray tube comprising in an evacuated envelope at least one electron gun to generate an electron beam directed onto a target and first and second pairs of deflection means for deflecting the electron beam in two mutually perpendicular directions.

Such a cathode ray tube is used, for example, in an oscilloscope with which measurements of electrical signals can be performed. The picture displayed on the display screen of the oscilloscopes cathode ray tube by the electron beam is used to obtain data by referring to a measuring grid provided on the display screen.

Such a cathode ray tube is disclosed in Netherlands Patent Specification 59,153, corresponding to U.S. Pat. 2,258,643. In this case a number of permanent magnets are provided on the side of the target outside the envelope to correct for trapezoidal distortions of the frame described by the electron beam on the target. However, by using only these permanent magnets it is difficult to provide a magnetic field distribution throughout the target that brings about only the desired corrections. Moreover, other corrections are often necessary in addition to the frame corrections, such as, the correction of nonlinearity and orthoganality defects, which are particularly difficult to obtain with such permanent magnets.

SUMMARY OF THE INVENTION

It is an object of the invention to provide a cathode ray tube in which internal means are provided which can effect correction of the large number of defects possibly occurring in such cathode ray tubes, in a simple and effective manner. In accordance with the invention at least one ring of a magnetic material permanently magnetized as a multipole, is positioned between the first pair of deflection means and the target. The ring is mounted in the tube in an unmagnetized condition and, after assembly of the tube, the ring is permanently magnetized as a multipole specifically configured to perform the desired corrections.

A colour display tube is disclosed in Netherlands Patent Application 7707476 (PHN 8845), corresponding to U.S. Pat. 4,220,897 in which, in order to produce the static convergence of three electron beams generated therein, a ring of a magnetic material is mounted inside the neck of the display tube and is magnetized as a multipole by external means after assembly of the display tube. In a cathode ray tube according to the invention having one electron beam, or two electron beams in each deflected by separate means, the problem of static convergence does not occur, and the ring magnetized as a multipole is positioned and configured differently for the correction of entirely different defects.

In first embodiment of a cathode ray tube according to the invention, a ring (magnetized as a multipole) is mounted between the first pair of deflection means and the second pair of deflection means. By positioning the ring magnetized as a multipole in this location, it effects corrections of the electron beam deflection by the first pair of deflection means. If this first pair of deflection means produces vertical deflection, the ring corrects a vertical line written on the target by means of the electron beam, which line should coincide with the vertical axis of a measuring grid provided on the display screen. By means of the ring, magnetized as a multipole, corrections can be made, for example, of the position of the line so that it passes through the centre of the display screen and coincides with the vertical axis of the measuring grid, of the length of the line, and of errors in linearity.

In accordance with the invention the ring (magnetized as a multipole) may be attached to a plate-shaped electrode provided with a slot-shaped aperture. This electrode is positioned between the first and second pairs of deflection means, and is known as an "interplate shield". The ring of magnetic material, which should not be subjected to welding operations because such operations might cause a change in the magnetic properties can be secured to the plate-shaped electrode by means such as clamps.

In second embodiment of the cathode-ray tube according to the invention, a ring (magnetized as a multipole) is positioned between the second pair of deflection means and the target, which is typically a phosphor display screen. Other types of targets include a storage target, a micro channel plate, a bistable storage target and a so-called scan converter target. By means of the ring magnetized as a positioned after the second pair of deflection means, a number of corrections can be made on the electron beam which has been deflected in two mutually perpendicular directions. Exemplary correction include relocation of the position of the electron beam spot on the display screen, rotation of the two deflection directions relative to each other, and corrections of a number of frame distortions caused by centring defects between, for example, the axis of the electron gun and the axis perpendicular to the centre of the target.

In third embodiment of a cathode ray tube according to the invention, the ring magnetized as a multipole is attached to a supporting ring positioned between the second pair of deflection means and the target. Such a supporting member is disclosed in Netherlands Patent Application 7401634 corresponding to U.S. Pat. No. 3,819,984 where it is used to secure a curved mesh for deflection amplification and postacceleration of the electron beam. The magnetized ring can also be attached to a sleeve which is often used as a supporting element for such a mesh. It is to be noted that instead of a curved mesh, a flat mesh, a curved plate having a slot-shaped aperture, a so-called box lens or a quadrupole lens may also be used to obtain deflection amplification and postacceleration.

In a preferred embodiment of the invention multipole rings are positioned both between the first and second pairs of deflection means and between the second pair of deflection means and the target. By positioning two rings in the above-described locations complete correction of deflection errors in all directions can be obtained. For example, when the vertical and horizontal deflection directions are orthogonal but are rotated relative to the vertical and horizontal axes of the measuring frame, this can be corrected completely by means of two rings. The ring between the horizontal deflection means and the target can be used to rotate the horizontal deflection direction so that it coincides with the horizontal axis of the measuring grid. This also causes rotation of the vertical deflection direction, causing the orthogonality of the two deflection directions is lost, but orthogonality can be restored by means of the other ring which rotates only the vertical deflection direction.

In fourth embodiment of a cathode ray tube according to the invention, an electron gun for generating an electron beam comprises a cathode and a ring magnetized as a multipole mounted between the cathode and the first pair of deflection means. By positioning the ring before the deflection means, deviations from the desired shape of the electron beam spot on the display screen can be corrected by means of a multipole, in addition to errors as a result of deviations in the centring of the electrodes, Intentional changes in the shape of the electron beam can also be made so that, for example, an elongate spot is formed on the display screen.

In a preferred embodiment of a cathode ray tube in accordance with the invention, the electron gun comprises a cathode, a substantially plate-shaped anode, a cylindrical focusing electrode and a substantially plate-shaped accelerating electrode, and the ring (magnetized as a multipole) is mounted on the accelerating electrode. It is to be noted that U.S. Pat. No. 3,877,830 discloses a cathode ray tube in which a cylindrical anode contains a ring of permanent magnetic material which is magnetized from the exterior. However, the ring is magnetized only as a dipole and is used exclusively to centre the electron beam on an aperture of a diaphragm placed in the anode. Other corrections such as intentional changes in the shape of the electron beam by means of a multipole ring are not disclosed.

A ring magnetized as a multipole, in the electron gun, can be advantageously combined with a ring between the first and second pair of deflection means and/or between the second pair of deflection means and the target.

BRIEF DESCRIPTION OF THE DRAWINGS

The invention will now be described in greater detail, by way of example, with reference to the accompanying drawing, in which.

DESCRIPTION OF THE PREFERRED EMBODIMENTS

Figure 1A:
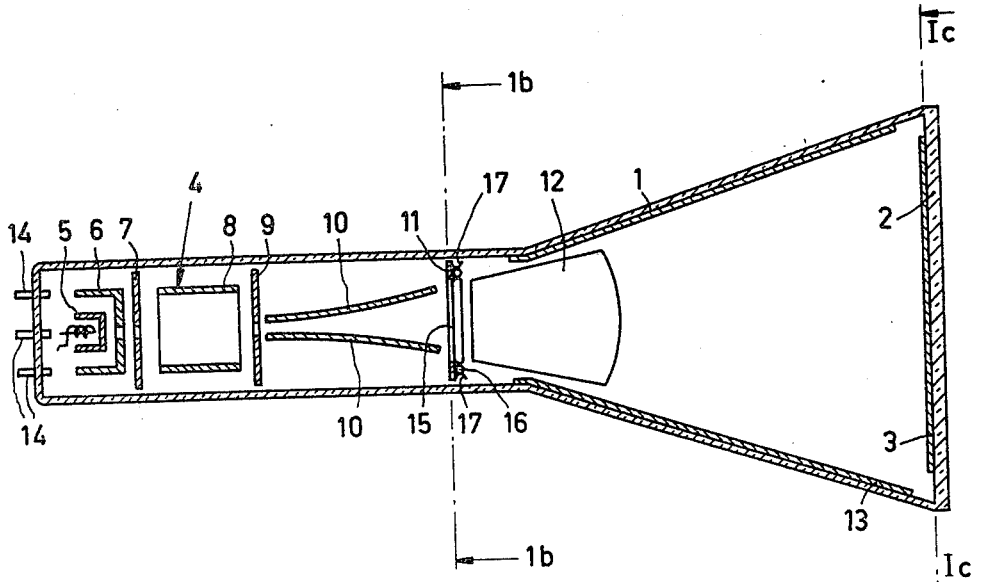
FIG. 1*a* is a diagrammatic longitudinal sectional view of a first embodiment of a cathode ray tube according to the invention.
Figure 1B:
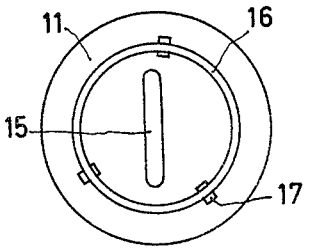
FIG. 1*b* is a sectional view taken on the line Ib—Ib of FIG. 1.
Figure 1C:
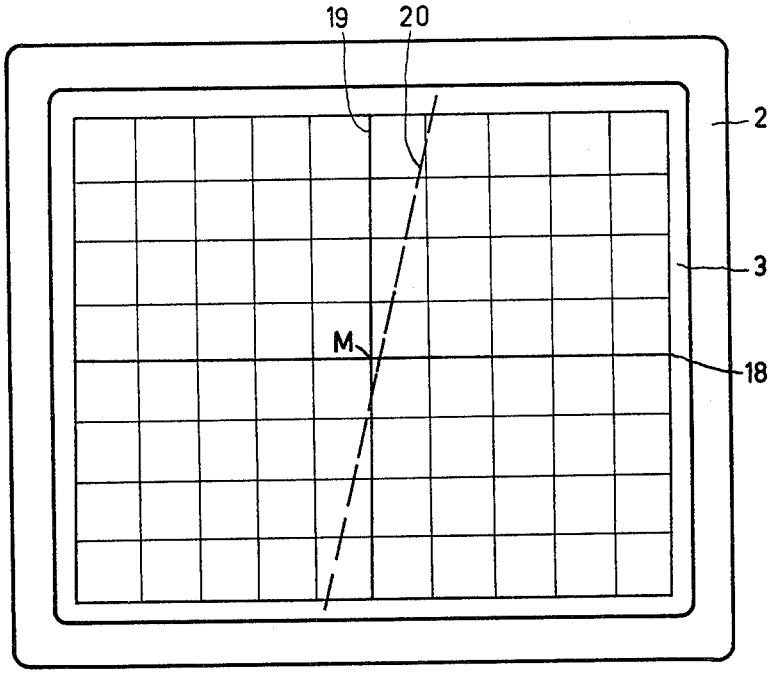
FIG. 1*c* is a sectional view taken on the line Ic—Ic of FIG. 1.

The cathode ray tube shown in FIG. 1 comprises a glass envelope 1 having a display window 2 on which a display screen 3 of a luminescent phosphor is provided which serves as a target.

An electron gun 4, for generating an electron beam to be directed onto the display screen 2, is secured in the neck of the tube. The electron gun comprises a cathode 5, an apertured grid 6 and a plate-shaped apertured accelerating anode 7. The electron beam is focused onto the display screen by means of a cylindrical focusing electrode 8 and a second accelerating electrode 9. The electron beam is deflected by a first pair of deflection means in the form of deflection plates 10 for the vertical deflection and a second pair of deflection means in the form of deflection plates 12 for the horizontal deflection. In addition to deflection plates, deflection means in the form of a delay line may also be used in cathode-ray tubes operating at very high frequencies. It is also possible to reverse the positions of the vertical and horizontal deflection plates. A plate-shaped accelerating electrode 11 (interplate shield) having a slot-shaped aperture 15 positioned between the first pair of deflection plates 10 and the second pair of deflection plates 12. The inner surface of the cone of the tube 1 is covered with a conductive coating 13. (The means for connecting the electrodes in the cathode ray tube pins 14 connected in the cap of the neck of the tube are not shown for reasons of clarity.) By applying a suitable potential to only the vertical deflection plates 10, a vertical line can be displayed on the display window which should coincide with the vertical axis of a measuring grid provided on the display window 2. Errors in the position of this line and in vertical deflection linearity can be caused inter alia by centring errors occurring during assembly of the gun electrodes in the tube. To facilitate correction of these errors, a ring 16 of a permanently magnetizable material is mounted on the plate-shaped electrode 11. The ring 16 is manufactured from a magnetic material as described in Netherlands Patent Application 7703075 (PHD 76-060), corresponding to U.S. Patent Application 67,066 filed on 15 Aug. 1979, which is considered to be incorporated by reference. It consists, for example, of an alloy of Fe, Co, V and Cr, which alloy is known by the trade name Coerflex (a trade mark of Messrs.Krupp). The ring 16 should not be subjected to any welding operations because this would cause the magnetic properties to vary. Therefore, the ring 16 is secured to the plate-shaped electrode or interplate shield 11 by means of a number of clamps 17, which are visible in FIG. 1*b* where the interplate shield 11 with the slot-shaped aperture 15 is shown in elevation.

In one exemplary embodiment the ring 16, has a diameter of approximately 19 mm and a thickness of approximately 1.1 mm. It is not necessary for the ring 16 to be attached to the plate-shaped electrode 11. Alternatively ring 16 may be mounted between the vertical and horizontal deflection plates in a different place, for example, by connecting the ring 16 to glass rods which are commonly used for positioning the electrodes in a cathode ray tube.

The ring 16 is secured in the tube in the unmagnetized condition and after the manufacture of the tube it is magnetized by external means to form a multipole magnet for correcting observed errors. The magnetization of the ring 16 is carried out by a method such as that disclosed in Netherlands per se Patent Application 7707476, corresponding to U.S. Pat. No. 4,220, 897 which is hereby incorporated by reference.

Briefly, this magnetizing is carried out as follows. A magnetizing unit is placed around the neck of the tube in the area of the ring 16. It comprises a large number of coils with which all desired multipoles, for example, dipoles, quadrupoles, hexapoles and octapoles can be generated. First the coils are energized so that a multipole is obtained which removes the errors in the tube. The currents through the coils determine the strength and configuration of the desired multipole. By reversing and multiplying the currents through the coils, and by generating in the ring 16 a decaying magnetic alternating field the ring 16 is magnetized as the desired multipole.

By locating the ring 16 between the vertical and horizontal deflection plates, corrections can be made in the vertical deflection direction. The corrections have no influence on the subsequent (horizontal) deflection. The desired number of poles of the multipole is determined by the nature and the magnitude of the correction to be made, which can be determined by observing the picture on the display screen.

For example, if it appears that during purely vertical deflection of the electron beam the vertical line displayed is shifted in a horizontal or vertical direction relative to the vertical axis of the measuring grid provided on the display window, the position of the vertical line can be corrected by magnetizing the ring 16 as a dipole with poles in the vertical or horizontal direction, respectively. When the vertical line displayed is rotated relative to the vertical axis of the measuring grid, this can be corrected by magnetizing the ring 16 as a quadrupole with poles which coincide with the vertical and horizontal deflection directions.

If the deflection of the first pair of vertical deflection plates is too large or too small so that the length of the vertical line is larger and smaller, respectively, than the vertical axis of the measuring grid, this is corrected by magnetizing the ring 16 as a quadrupole with poles on axes which form angles of 45° with the vertical and horizontal deflection directions, which results in a variation of the deflection sensitivity in the vertical direction. Non-linearities in the vertical deflection as a result of deflection plates which are not formed correctly during the manufacture or are not assembled correctly can also be corrected by means of, for example, a ring 16 magnetized as a hexapole. Linearity of the deflection is to be understood to mean herein that the position of the spot of the electron beam on the display screen along the vertical axis of the measuring grid extends linearly with a voltage supplied to the vertical deflection plates so that the resulting line displayed is linear, with respect to a vertical measuring grid line. In addition to the correction of linearity errors it is also possible with such a magnetized ring to introduce linearity errors in the deflection so as to compensate, for example, for linearity errors in the amplifiers of a device driving a cathode ray tube. By means of a ring 16 magnetised as, multipole a bending of the vertical line caused, for example, by a non-parallelism of the vertical deflection plates can also be corrected.

Figure 1D:
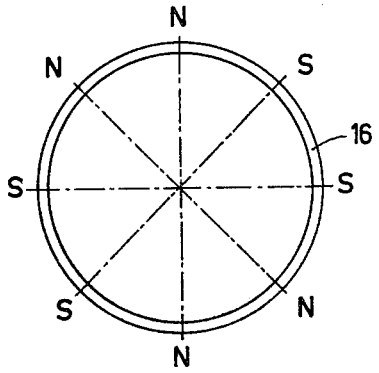
FIG. 1*d* shows an example of a ring magnetized as a multipole.

In addition to the above-mentioned errors, combinations of these errors can be corrected by means of a ring 16 magnetized as a multipole. An example hereof will be explained in detail with reference to FIGS. 1*c* and 1*d*. Reference numeral 2 in FIG. 1*c* denotes the glass display window on which the display screen 3 consisting of a luminescent phosphor is provided. A measuring grid 18 is also provided on the display window 2. If a suitable alternating voltage is applied to only the vertical deflection plates 10, a vertical line will be displayed on the display screen 3. This line should coincide with and be as long as the vertical grid line 19 of the measuring grid 18. The line displayed on the display window 3 is denoted by the broken line 20. The line 20 is shifted with respect to and is rotated about the centre M of the measuring grid 18. The line 20 is also longer than the vertical grid line 19 of the measuring grid 18, whereas these lengths should be equal. These errors can be individually corrected by magnetizing the ring 16 as a dipole with poles in the vertical direction, as a quadrupole with poles in the horizontal and vertical directions, and as a quadrupole with poles at an angle of 45° with the vertical and horizontal directions, respectively. However, FIG. 1*d* shows how the ring 16 could be magnetized as a multipole for simultaneously correcting these three errors. The north and south poles are denoted by N and S, respectively. The desired multipole configuration is a superposition of the multipoles which are required for the correction of each of the errors individually.

Figure 2:
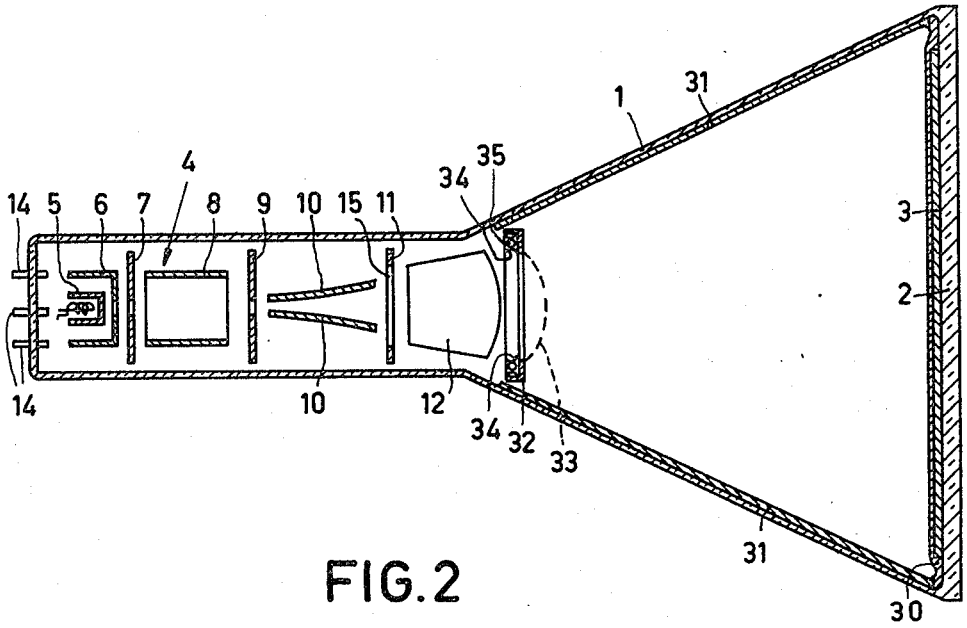
FIG. 2 is a diagrammatic longitudinal sectional view of a second embodiment of a cathode ray tube according to the invention.

FIG. 2 shows another embodiment of a cathode ray tube according to the invention. Corresponding parts are referred to by the same reference numerals as in FIG. 1. The luminescent phosphor layer 3 on the display window 2 has a thin metal layer 30. The inner surface of the cone of the tube is covered with a conductive coating 31 which is connected electrically to the metal layer 30. After the horizontal deflection plates 12 a curved mesh 33 is secured in the tube to a supporting ring 32. Together with the conductive coating 31 the curved mesh 33 forms a diverging electrostatic lens field so that deflection amplification is obtained causing the electron beam to describe a frame on a larger part of the display screen. A ring 35 of magnetizable magnetic material is secured to the supporting ring 32 by means of clamps 34. The ring 35 is magnetized as a multipole after assembling the tube, as already described. By magnetizing the ring 35 as a dipole with poles in the vertical or horizontal direction, the position of the spot of the electron beam on the display window can be placed in the centre of the display window. The orthogonality of the vertical and horizontal deflection directions can be corrected by magnetizing the ring 35 as a quadrupole with poles in the vertical and horizontal directions, so that the two deflection directions are rotated relative to each other. It is also possible to increase the sensitivity of the deflection in the vertical direction at the expense of the sensitivity of the deflection in the horizontal direction by magnetizing the ring 35 as a quadrupole with poles at an angle of 45° with the vertical and horizontal deflection directions. The multipole ring 35 can also be used to correct frame distortions caused by centring errors between the axis of electron gun 4, the curved mesh 33 and the tube 1. Besides a curved mesh secured to a supporting ring, other accelerating means may be used, such as a flat mesh connected to a supporting ring, a curved plate having a slot-shaped aperture, a box lens or a quadrupole lens. It is to be noted that a multipole ring between the second pair of deflection plates and the target also be used in cathode ray tubes without post-acceleration, such as that shown in FIG. 1*a*.

In a preferred embodiment of a cathode ray tube in accordance with the invention, a ring magnetized as a multipole is present both between the first and second pairs of deflection plates and on the supporting ring of the curved mesh. With this tube configuration, the shapes and the angles of the vertical and horizontal deflection directions relative to the measuring grid can be fully corrected, but the two rings can be magnetized independently of each other. The magnetization field for the last magnetized ring may not vary or erase the field established in the first magnetized ring. If the mutual distance between the two rings is too small to magnetize them independently of each other, the two rings may also be magnetized together.

Figure 3:
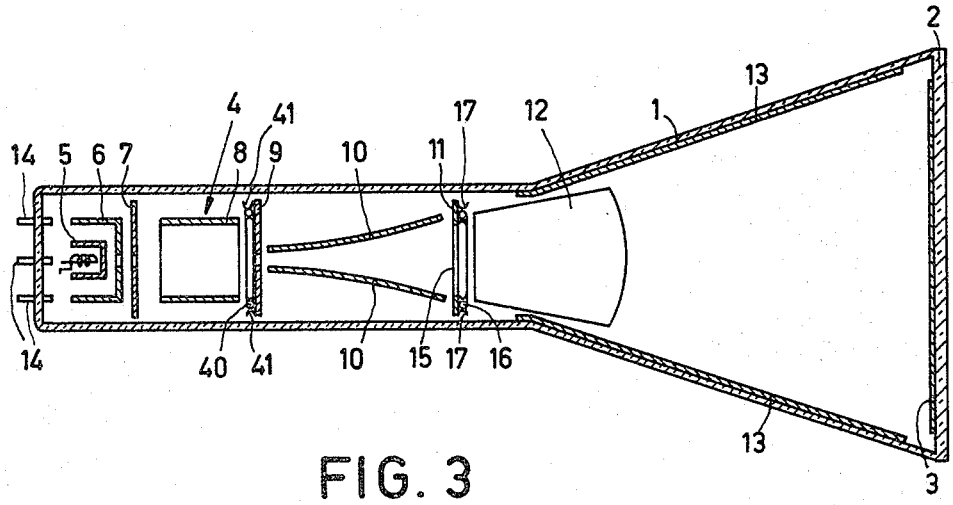
FIG. 3 is a diagrammatic longitudinal sectional view of a third embodiment of a cathode ray tube according to the invention.

FIG. 3 shows another embodiment of a cathode ray tube according to the invention. Corresponding components are again referred to by the same reference numerals as in FIG. 1. Two permanently magnetizable rings of a magnetic material are provided in the tube. A first ring 16 is attached to the electrode 11 between the first pair of deflection plates 10 and the second pair of deflection plates 12. A second ring 40 is, on the side of the electrode 9 facing the cathode 5 by means of clamps 41. The second ring 40 may also be connected to the focusing electrode 8. By magnetizing the ring 16 as a quadrupole, a number of corrections as described with reference to FIG. 1 can be effected, but the shape of the electron beam spot on the display window will vary as a result of the focusing and defocusing effect of this quadrupole. The shape of the electron beam spot on the display window can be corrected by also magnetizing the ring 40 as a qaudrupole. By further magnetizing the ring 40 as a dipole, errors resulting from errors in the centring of the electrodes of the electron gun 4 can also be corrected thereby effecting optimal guidance of the electron beam by the pairs of deflection plates 10 and 12 towards the centre of the display window 2.

The sensitivity of the tube can be increased by the combination of the ring 40 and the ring 16, because this combination optimizes the path of the electron beam through the pairs of deflection plates 10 and 12, and thus the distance between the vertical deflection plates 10 can be made small.

A ring preceding the first pair of deflection plates can also be combined with a ring between the second pair of deflection plates 12 and the display window 2, or with a ring between the first pair of deflection plates 10 and the second pair of deflection plates 12 and a ring between the second pair of deflection plates 12 and the display window 2.

What is claimed is:

1. A cathode ray tube comprising, in an evacuated envelope, a target, an electron gun for directing an electron beam onto the target, first and second deflection means for successively deflecting the electron beam in mutually perpendicular directions, and a permanently magnetized multipole ring positioned between the first deflection means and the target, said ring having a plurality of magnetic poles for producing a magnetic field which is a composite of magnetic fields for correcting respective errors in beam deflection.

2. A cathode ray tube as in claim 1, where the multipole ring is positioned between the first and second deflection means.

3. A cathode ray tube as in claim 2 including a plate-shaped electrode, having a slot-shaped aperture, mounted between the first and second deflection means, said ring being attached to said electrode.

4. A cathode ray tube as in claim 1 where the multipole ring is positioned between the second deflection means and the target.

5. A cathode ray tube as in claim 4, including a supporting ring for a deflection amplification element mounted between the second deflection means and the target, said ring being attached to said supporting ring.

6. A cathode ray tube as in claim 1, 2, 3, 4 or 5, and further including a second permanently magnetized multipole ring positioned between a cathode of the electron gun and the first deflection means for correcting the shape of a spot formed on the screen by the electron beam.

7. A cathode ray tube as in claim 6, where the electron gun comprises, successively, the cathode, a plate-shaped anode, a cyindrical focusing electrode, and a plate-shaped accelerating electrode, and where the second ring is mounted on the accelerating electrode.

8. A cathode ray tube as in claim 5 where said deflection amplification element comprises a curved mesh element secured to the supporting ring.

* * * * *